US010315813B2

(12) United States Patent
Landman

(10) Patent No.: US 10,315,813 B2
(45) Date of Patent: Jun. 11, 2019

(54) METHOD AND APPARATUS FOR PACKAGING BEVERAGE UNDER PRESSURE

(75) Inventor: Bernardus Cornelis Johannes Landman, Boskoop (NL)

(73) Assignee: HEINEKEN SUPPLY CHAIN B.V., Amsterdam (NL)

( * ) Notice: Subject to any disclaimer, the term of this patent is extended or adjusted under 35 U.S.C. 154(b) by 0 days.

(21) Appl. No.: 13/981,432

(22) PCT Filed: Feb. 13, 2012

(86) PCT No.: PCT/NL2012/050076
§ 371 (c)(1),
(2), (4) Date: Oct. 11, 2013

(87) PCT Pub. No.: WO2012/112035
PCT Pub. Date: Aug. 23, 2012

(65) Prior Publication Data

US 2014/0027453 A1 Jan. 30, 2014

(30) Foreign Application Priority Data

| | | |
|---|---|---|
| Feb. 14, 2011 | (NL) | 2006195 |
| Feb. 14, 2011 | (NL) | 2006197 |
| Feb. 14, 2011 | (NL) | 2006199 |
| May 27, 2011 | (WO) | PCT/NL2011/050367 |
| May 27, 2011 | (WO) | PCT/NL2011/050369 |

(51) Int. Cl.

| | |
|---|---|
| ***B65D 51/16*** | (2006.01) |
| ***B67D 1/04*** | (2006.01) |
| ***B65B 7/00*** | (2006.01) |

(52) U.S. Cl.
CPC ..... *B65D 51/1633* (2013.01); *B65B 7/00* (2013.01); *B67D 1/0443* (2013.01)

(58) Field of Classification Search
CPC .. B65B 7/025; B65B 7/00; B65B 7/02; B65B 31/10; B65D 51/1633; B65D 83/62; B65D 83/663; B67D 1/0443; B67D 1/0418; A23L 2/40
USPC ..... 137/543.15; 220/203.01; 222/1, 131, 222/394, 396, 402.1; 53/452; 62/386
See application file for complete search history.

(56) References Cited

U.S. PATENT DOCUMENTS 2,514,773 A * 7/1950 Kromer ..... 62/166
2,620,107 A * 12/1952 Tolan ..... B67D 1/0857 222/131
2,675,686 A * 4/1954 Dickinson ..... F25D 3/12 220/592.18

(Continued)

FOREIGN PATENT DOCUMENTS

DE 1657342 A1 2/1971
EP 1064221 A1 1/2001

(Continued)

*Primary Examiner* — David P Angwin
*Assistant Examiner* — Bob Zadeh
(74) *Attorney, Agent, or Firm* — Pearne & Gordon LLP

(57) ABSTRACT

Method for manufacturing a pressurising device for a beverage container, wherein a gas container is provided having a filling opening, into which gas container an amount of dry ice is inserted through the filling opening, where after the filling opening is closed and the dry ice is allowed to sublimate.

11 Claims, 5 Drawing Sheets

(56) References Cited

U.S. PATENT DOCUMENTS

| | | | | | |
|---|---|---|---|---|---|
| 3,211,350 | A * | 10/1965 | Brown | B67D 1/0412 | 222/399 |
| 3,244,326 | A * | 4/1966 | Bull, Jr. | B67D 1/045 | 220/720 |
| 3,614,875 | A * | 10/1971 | McCallum | F25D 3/00 | 383/103 |
| 4,049,158 | A * | 9/1977 | Lo | B65D 83/663 | 222/399 |
| 5,620,725 | A * | 4/1997 | Jamieson | B65D 85/73 | 206/222 |
| 5,704,222 | A * | 1/1998 | Hage et al. | 62/293 | |
| 6,360,923 | B1 | 3/2002 | Vlooswijk | | |
| 7,661,556 | B2 | 2/2010 | Van Der Klaauw et al. | | |
| 8,070,023 | B2 * | 12/2011 | Vitantonio | B67D 1/0418 | 222/396 |
| 2004/0069368 | A1 | 4/2004 | Van Der Klaauw et al. | | |
| 2006/0049215 | A1 * | 3/2006 | Lim et al. | 222/402.1 | |
| 2007/0241132 | A1 * | 10/2007 | Smith | B65D 83/38 | 222/95 |
| 2009/0044561 | A1 * | 2/2009 | Dalton | B67D 1/06 | 62/398 |
| 2010/0230433 | A1 * | 9/2010 | Kreyenberg | B67D 1/0418 | 222/1 |
| 2012/0318830 | A1 * | 12/2012 | Lim | B65B 31/10 | 222/402.1 |

FOREIGN PATENT DOCUMENTS

| | | |
|---|---|---|
| EP | 1289874 | 3/2003 |
| JP | S54-125181 A | 9/1979 |
| WO | 2005007560 A2 | 1/2005 |
| WO | 2006086032 A2 | 8/2006 |

* cited by examiner

METHOD AND APPARATUS FOR PACKAGING BEVERAGE UNDER PRESSURE

The invention relates to a method for manufacturing a pressure regulating device for a beverage container. The invention further relates to a pressure regulating device, a beverage container and a filling line for beverage containers.

From EP1064221 a beverage container is known, comprising a pressure regulating device for maintaining a substantially constant pressure in the container. The beverage container can comprise dispensing means and can be ready for dispensing beverage from the container, independently from a tapping device, external $CO_2$ containers and the like. A gas container of the pressure regulating device is filled with CO2 gas under pressure through an aerosol valve. Then a pressure regulator is mounted on the gas container for controlling opening and closing of the aerosol valve.

An object of the present invention is to provide an alternative method for forming a pressure regulating device. Another object of the invention is to provide an easy method of forming a pressure regulating device and/or a beverage container.

Another object is to provide a pressure regulating device and a beverage container comprising such pressure regulating device. Moreover an object is to provide a filling line for beverage containers.

In a first aspect the description discloses a method for manufacturing a pressurising device for a beverage container, wherein a gas container is provided having a filling opening. An amount of dry ice is inserted through the filling opening into the gas container. The filling opening is closed and the dry ice is allowed to sublimate.

In a second aspect the description discloses a pressure regulating device for a beverage container, comprising a gas container. The gas container is partly filled with dry ice.

In a third aspect the description discloses a beverage container comprising a pressure regulating device for regulating pressure in the beverage container. The pressure regulating device comprises dry ice or gas formed from sublimation of dry ice within the pressure regulating device.

In a fourth aspect the description discloses a filling line for beverage containers, wherein on the filling line a dry ice dispenser is provided for dispensing an amount of dry ice into a gas container of a pressure regulating device provided for the beverage container.

Embodiments of the present invention shall be described, with reference to the drawings, for elucidation of the invention. These embodiments should by no means be understood as limiting the scope of the invention in any way or form. In these drawings.

In this description and the drawings the same or similar elements have the same or similar reference signs. In this description the invention shall specifically be described with reference to a carbonated beverage container and a pressure regulating device therefore, especially for beer.

Figure 1:
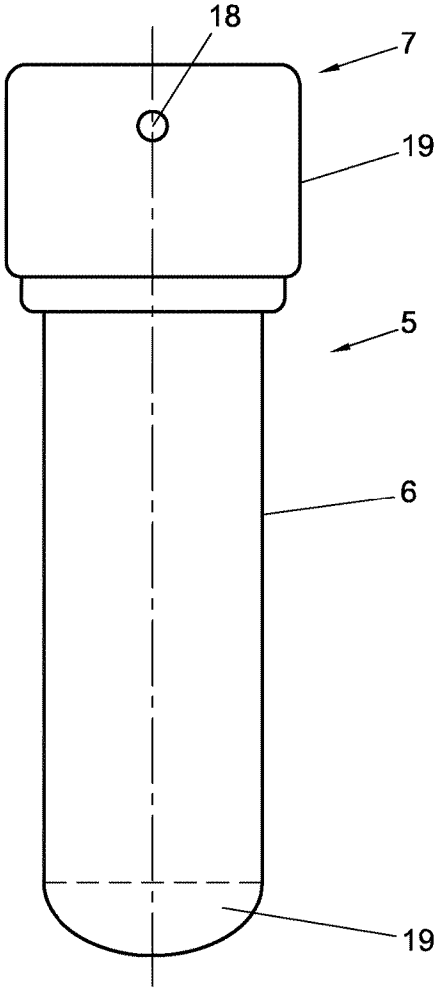
FIG. 1 shows schematically a gas container for a pressure regulating device comprising dry ice and such gas container closed by a pressure regulator.
Figure 1:
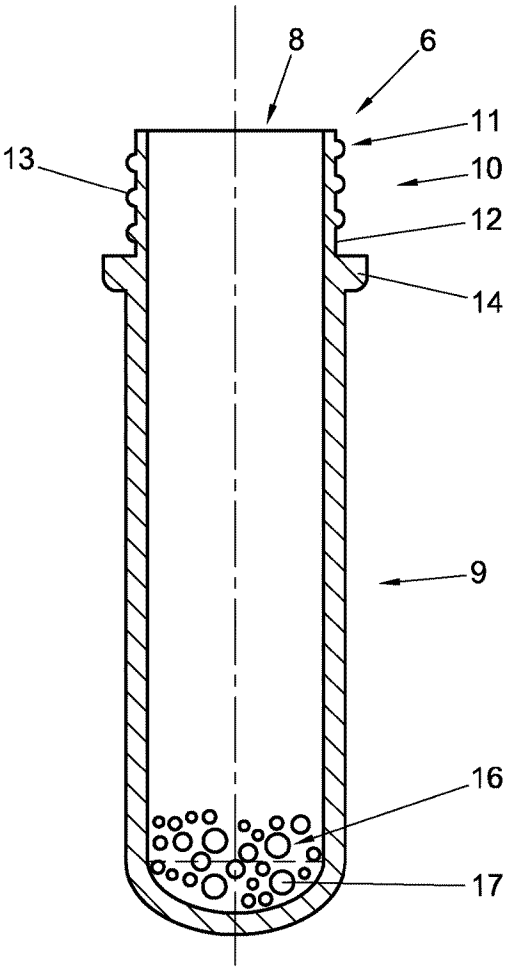

In this description dry ice has to be understood as at least comprising solidified gas, especially solidified $CO_2$. Dry ice can be frozen $CO_2$. Solid ice can be $CO_2$ gas that is pressurised and/or cooled to a temperature and pressure such that the $CO_2$ is transformed from gas to solid, for example −70 to −80° C. at about atmospheric pressure, and can change back, especially sublimate back to gas when the temperature is raised and/or the pressure is reduced. 1 kilo of dry ice 16 can for example sublimate into about 500 liter of $CO_2$ gas.

In this description by way of example a beverage container 1 is shown, comprising a body 2 and a neck 3, wherein the neck 3 defines or at least comprises a dispense opening 4. The beverage container 1 can be made of metal but is preferably made of plastic, such as but not limited to PET or a PET blend, single or multi layer. The beverage container 1 can be blow moulded from a pre form, in a known manner. A beverage container can have a volume of for example a few liters, for example one to two liters of larger. A beverage container 1 can for example have an internal volume of about 5 liters or more, such as but not limited to more than 10 liters. A beverage container 1 can for example have an internal volume between about 10 and 25 liters, such as for example about 17 liters.

In FIG. 1 at the left has side a gas container 6 is shown, comprising dry ice 16. At the right hand side a pressure regulating device 5 is shown, comprising such gas container 6. This pressure regulating device 5 can be used in or for a beverage container 1, for example as described here above. The pressure regulating device 5 can comprise a gas container 6 and a pressure regulator 7 mounted on or over a filling opening 8 of the gas container 6. The gas container 6 can be made of for example metal. In another embodiment the gas container 6 can be made of plastic, for example PET, PEN, PE or such thermoplastic material. The gas container 6 can have a body 9 and a neck portion 10, which can for example be substantially tubular. The neck portion 10 can have a mounting means 11, for example around the outer peripheral wall 12, wherein the mounting means 11 can be screw threads 13 or other elements, such as but not limited to click means. The gas container 6 can have substantially the shape and dimensions of a preform for blow moulding a bottle. A flange 14 can be provided extending outward from the neck portion 10. The neck portion 10 can define the filling opening 8. The function thereof shall be discussed hereafter.

In the gas container 6 an amount of dry ice 16 is provided. The dry ice 16 is shown as a series of solid elements, such as granules 17. The dry ice can be provided as powder, ground ice, pellets or the like. In another embodiment the dry ice 16 can be provided as a single, solid element. The solid dry ice can sublimate in the gas container 6, when the temperature and pressure in the gas container are suitable for such sublimation. The dry ice 16 can be fed into the gas container 6 through the filling opening 8. The filling opening can be closed by a lid 19, which can for example be mounted onto the mounting means 11, for example by complementary screw threads. The lid 19 can close the gas container 6 such that gas, especially CO2 gas formed by the sublimation of the dry ice 16 cannot escape the gas container 6 through the filling opening 8, at least not in an uncontrolled manner.

In FIG. 1 at the right hand side a pressure regulator 7 is shown, which is provided over the filling opening 8 of the gas container 6, as a lid 19. The pressure regulator 7 can allow gas to be expelled from the gas container 6 to the surroundings, through for example opening 18, depending of a pressure prevailing in the surroundings. Various such pressure regulators 7 are known in the art, for example from EP1064221. To this end a pressure regulated valve can be provided in the regulator 7. Alternatively the filling opening 8 can be provided spaced apart from, for example at an end of the gas container opposite the pressure regulator 7. The lid 19, as shown schematically in FIG. 1, right hand side, as optional, indicated by dashed line, can then be provided over the filling opening after feeding the dry ice 16, wherein the pressure regulator 7 can be pre-mounted or integral with the gas container 6. An advantage of using dry ice 16 can be that the gas container 6 is at about atmospheric pressure when the lid 19 and/or the pressure regulator 7 is mounted on the gas container 6.

Figure 2:
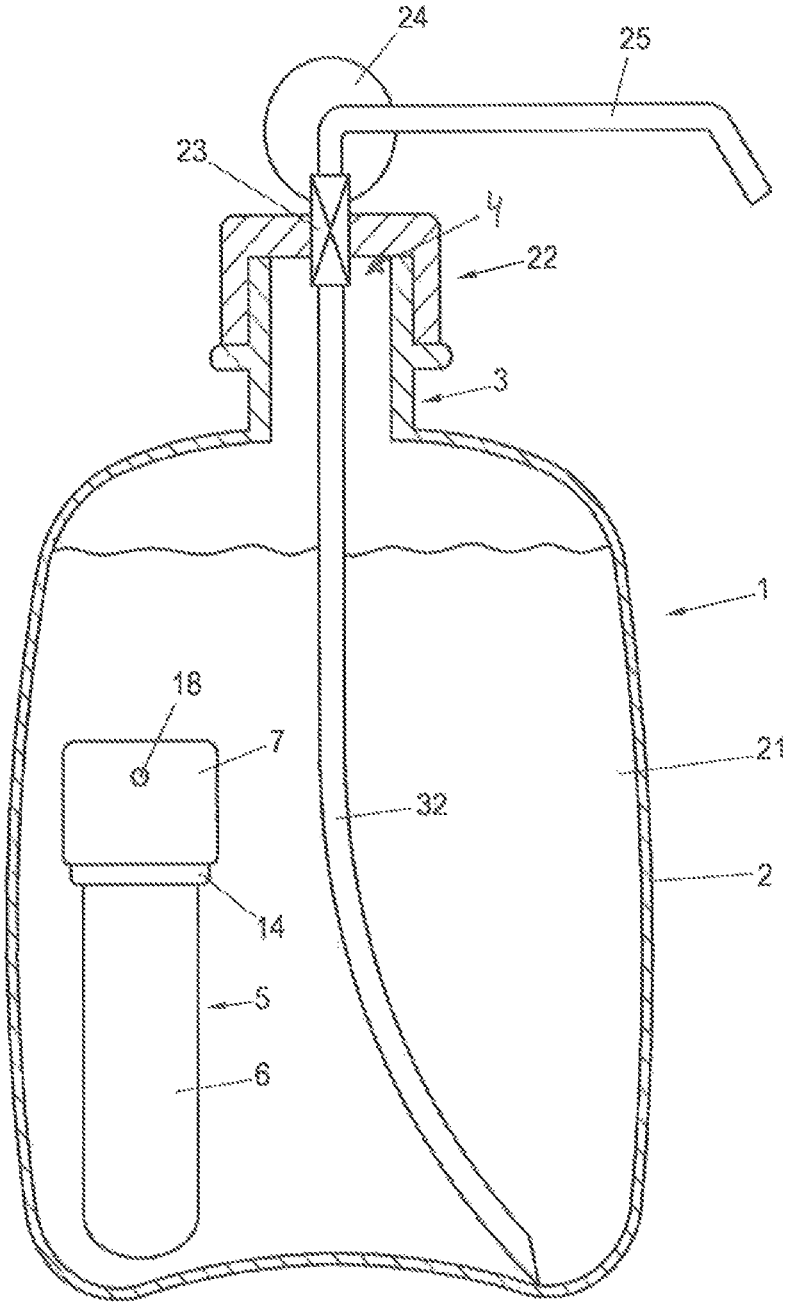
FIG. 2 shows schematically a pressure regulating device of FIG. 1 provided in a beverage container.

In the embodiment shown in FIG. 2 the pressure regulating device 5 is provided in beverage container 1. In this embodiment the pressure regulating device 5 can be placed in the body 2 of the beverage container 1. It can be fixed to a wall or the bottom of the container body 2, or can be placed freely in the body 2. Beverage, especially a carbonated beverage 21 such as beer is filled into the beverage container 1, where after a dispensing unit 22 is mounted on the neck 3 of the beverage container. The dispensing unit 22 can comprise a valve 23 and an operating knob 24 with a dispense tube 25. A dip tube 32 can extend from the valve 23 to the bottom portion of the body 2. The dry ice 16 in the pressure regulating device 5 sublimates and pressurises the gas container 6. The amount of dry ice 16 is chosen such that pressure is build up to above atmospheric, for example between 4 and 20 bar absolute, preferably between 5 and 16 bar, measured at a temperature of about 6° C. The pressure can for example be about 12 bar. In the beverage container 1, especially in the inner space thereof directly after filling a pressure of about 1 to 2 bar can be present, due to the filling pressure and/or carbon dioxide gas in the beverage. The pressure regulator 5 can be designed such that it regulates the pressure in said inner space at an equilibrium pressure of the beverage, for example between 1.2 and 1.6, such as for example about 1.4 bar absolute. When dispensing beverage from the container, the pressure will drop, which means that the pressure regulator will be activated, increasing the pressure back to or to slightly above the desired equilibrium pressure, such as for example disclosed in EP1289874. If desired a material 103 could be provided in the gas container for adsorbing and/or absorbing part of or all of the $CO_2$ gas, thus restricting the pressure raise inside the gas container 6 when the same amount of gas is formed, compared to a same container without such material. The material can for example be active coal or zeolite.

Figure 3:
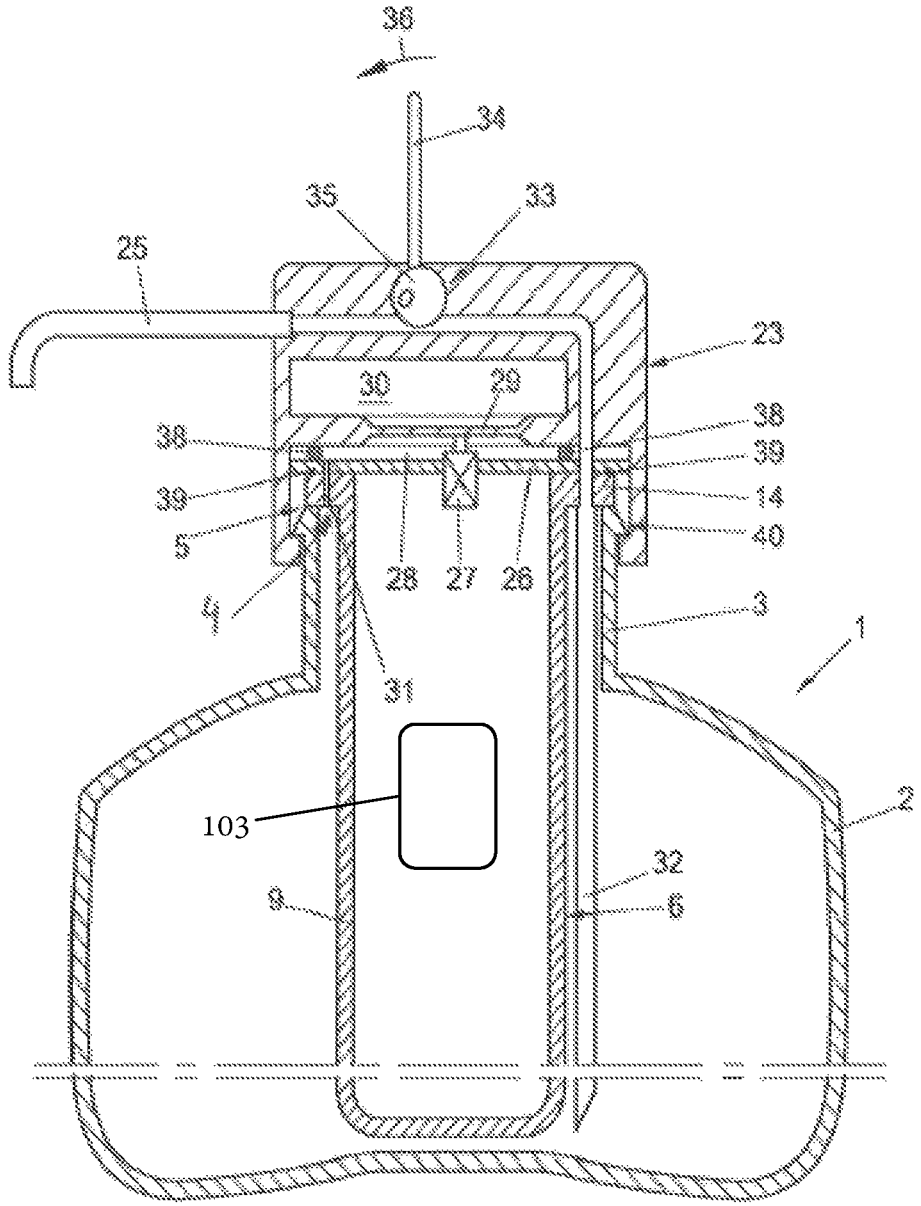
FIG. 3 shows schematically a pressure regulating device in a beverage container, mounted in a neck portion of the beverage container.

FIG. 3 shows an alternative embodiment of a beverage container 1, wherein the pressure regulating device 5 is suspended in the neck 3 of the container 1, part of the body of the gas container 6 extending into the inner space of the body 2 of the beverage container 1. In this embodiment the pressure regulator 5 is integrated with the dispensing device 23. The gas container 6 can rest on the free end of the neck 3 by the flange 14. The dispensing device 23 is mounted on the neck 3, for example by press fitting or click means 40, such that the dispensing device 23 is pressed against the flange 14, thus pressing the flange 14 against the neck and the gas container 6 is closed gas tightly. Suitable seals 38, 39 can be provided, if necessary.

A valve 27, for example an aerosol valve as described in EP1064221 is provided in a bottom 26 of the dispensing device 23, forming a connection between the inner space of the gas container 6 and a space 28 above the bottom 26. The bottom 26 can be an integral part of the dispensing device 23 or can be a separate part, which can be connected to the flange 14. At an opposite side of the space 28 a flexible wall part 29 of a pressure regulating chamber 30 is provided, resting against the valve 27. If the pressure in the space 28 drops below a regulating pressure, the wall part 29 will be forced, by pressure in the pressure regulating chamber 30, against the valve 27, opening the valve 27 and allowing gas to flow from the gas container 6 into the space 28. A passage 31 is provided through the bottom 26 and the flange 12, into the inner space of the beverage container 1. Thus pressure equilibrium will exist substantially between the space 28 and the inner space of the beverage container 1. When the pressure in the beverage container is back at the desired pressure, such as the equilibrium pressure, the wall part 29 will be pushed back and the valve 27 will close.

The pressure regulating chamber 30 can be a closed chamber. In an alternative embodiment a passage can be provided from the chamber 30 to an environment in which atmospheric pressure prevails.

A dip tube 32 extends from the inner space of the beverage container 1 past the gas container 6 and through the flange 14 into the dispensing device 23. The dispense tube 25 is connected to the dip tube 32 by a valve 33, which is in the embodiment shown can be a hose type valve, operationable by an arm 34 connected to an excentre 35. In FIG. 3 the valve 33 is shown in closed position. By moving the arm 34 in the direction of the arrow 36 the valve 33 is opened and beverage can be expelled from the beverage container 1 through the dip tube 32 and the dispense tube 25. Pressure in the beverage container 1 will be regulated by the pressure regulator 5 as described before. Moving the arm 34 back then the valve 33 is closed again. Clearly other types of valves 33 can be provided, for example an in line valve. Other means for operating the valve 33 can be provided. In other embodiments the valve 33 can be dispensed with, where the dispense tube can be provided with or connected to a dispense unit or valve to cooperate with a valve unit of a dispense unit, as for example described in EP1289874.

Figure 4:
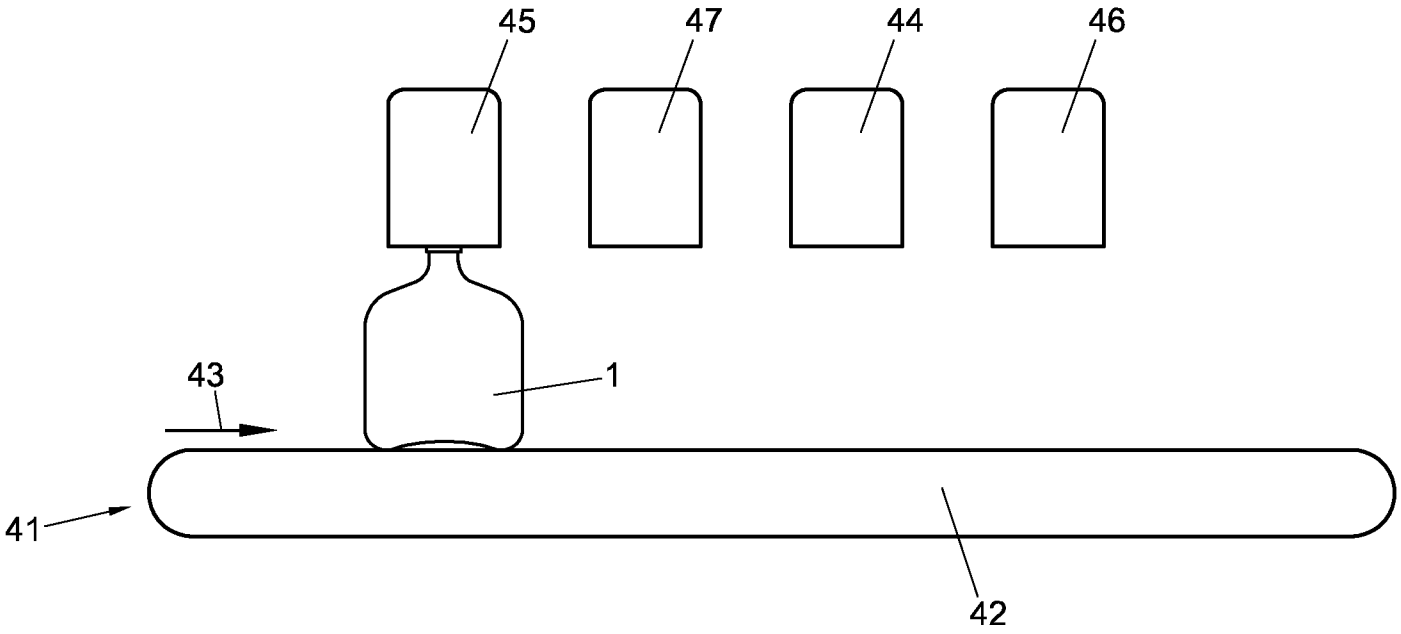
FIG. 4 shows schematically a filling line comprising a dry ice dispensing station.

In FIG. 4 discloses schematically a filling line 41 for beverage containers 1. The filling line 41 has a beverage container transport line 42 with a feeding direction 43. On the filling line 41 a dry ice dispenser 44 is provided for dispensing an amount of dry ice 16 into a gas container 6 of a pressure regulating device 5 provided for the beverage container 1. Upstream from the dry ice dispenser 44 a filling head 45 for filling beverage into the beverage container 1 is provided. Preferably downstream of the dry ice dispenser 44 a device 46 is provided for placing at least a pressure regulator 5 onto the gas container 6, more preferably onto the gas container 6 and the beverage container 1. The dry ice dispenser 44 can for example be volume or weight based in dosing the amount of dry ice 16. When the dispenser 44 is weight based a specific weight of dry ice 16 dispensed into the gas container 6 through the filling opening 8. Similarly a specific volume can be fed into the gas container 1. In each gas container the same amount of dry ice 16 can be fed.

In the embodiment as shown in FIG. 4 a beverage container 1 is used in which the gas container 6 is suspended in the neck 3 of the beverage container 1, or at least such that the filling opening 8 accessible from outside the beverage container 1. In this embodiment a beverage container 1 is blow moulded from a plastic perform and transported to the filling head 45 for filling the beverage container 1 with a beverage, especially beer. Then the gas container 6 is inserted into the neck 3 of the beverage container 1, by a container dispenser 47, such that it extends into the inner space of the beverage container 1. Then in the dry ice dispenser 44 the desired amount of dry ice 16 is fed into the gas container 6, where after in the device 45 the dispensing device 23 with the pressure regulator is mounted on the beverage container 1 and over the filling opening 8 of the gas container 6, closing off the containers 1, 6 and preparing the beverage container for use.

Dry ice can for example be provided as a solid bock or as pellets, formed by for example extrusion of dry ice into rods or the like shapes and pelletizing the rods into pellets which can then be weighed or otherwise measured for providing a desired quantity of dry ice into a container 6. To this end for example liquid CO2 can be made to form powder snow which can be pressed into blocks and/or through an extruder. Dry ice pellets as such are known from for example dry ice blasting. Dry ice can also be formed by making powder snow, which can be measured to provide a sufficient amount in a container 6. The powder snow could be created before entering the container 6 or could be created directly in the container 6, for example by injecting liquefied CO2 into the container 6.

In an embodiment the dry ice dispenser 44 could comprise means for reducing the size of the dry ice, for example crushing or grinding means for crushing or grinding dry ice formed into smaller elements or particles, such as powder or granules, which may ease dosing of a specific amount in a reliable manner.

Upon sublimation of the dry ice 16 into gas, the volume of the $CO_2$ will increase, filling the entire gas container 6 and increasing the pressure to for example above 4 bar, such as to about 6 to 12 bar. Especially when a plastic or thin walled metal gas container 6 is used, the gas container 6 will expand at least partly and at least slightly, especially in radial direction, such that its cross section inside the beverage container 1 may increase, such that the gas container cannot be retracted from the beverage container 1.

Figure 5:
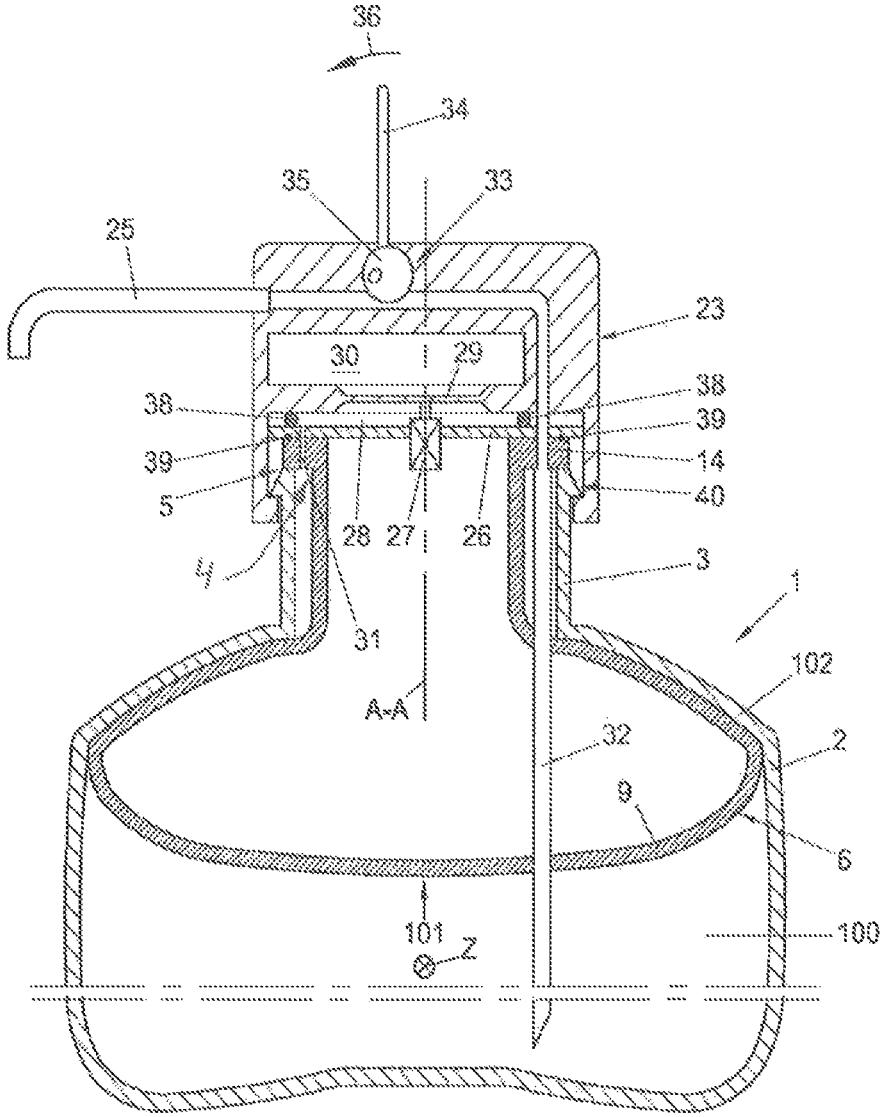
FIG. 5 shows schematically a pressure regulating device in a beverage container, mounted in a neck portion of the beverage container, in an alternative embodiment.

In FIG. 5 an embodiment is show of a container 1, similar to for example the embodiment of FIG. 3. For the elements not specifically described here reference is made to FIG. 3 and the further description. In the embodiment of FIG. 5 a different embodiment of a gas container 6 is used. In this embodiment the gas container 6 is mounted again in and/or on the neck 3 of the container 1, extending into the internal space 100. The internal space 100 is provided for being filled with a liquid, especially a beverage to be dispensed, such as but not limited to a carbonated beverage, such as beer. In the embodiment of FIG. 5 the gas container 6 is inserted into the internal space 100 through the neck 3, to which end the gas container 6 initially will have a substantially tube like configuration, for example substantially cylindrical, with a closed bottom end 101. Near the filling opening 15 the flange 14 can be provided. After insertion into the container 1 the gas container can be blown into its final shape, as for example shown in FIG. 5, wherein a body portion of the gas container 6 is extended at least radially, such that the cross section of the gas container 6 below the neck 3 will at least become such that the gas container 6 cannot be removed through the neck 3. Preferably the gas container 6 is blown up such that the body portion will at least partly be deformed against the inner surface of a shoulder portion 102 of the container 1 just below the neck 3, such that the gas container 6 is prevented from movement in an axial direction A-A of the neck 3.

The gas container 6 can initially substantially have the shape of a preform for stretch blow moulding a bottle, as known in the art. The gas container 6 can initially substantially have the shape of a gas container as shown in FIG. 1, with or without the threads 13.

In order to blow the gas container into its final shape as shown in FIG. 5, the gas container 6 can be inserted into the container 1, where after an amount of dry ice 16 can be inserted into the gas container, as discussed before. The amount of dry ice can be chosen as discussed, such that sufficient pressure can be build up inside the gas container 6. The gas container can be closed temporarily or permanently, for example by the pressure regulator as discussed with reference to FIG. 3. In an alternative embodiment the gas container can be provided with a pressure regulator of a different kind, for example as shown in and discussed with reference to FIGS. 1 and 2, and can be inserted into the inner space entirely.

Preferably the gas container 6 is inserted into the container 1 after filling the inner space 100 with a sufficient amount of liquid, such as beer. When thereafter the gas container 6 is blown into its desired shape, as for example shown in FIG. 5, the liquid will be pressurised at least slightly by the expansion of the body of the gas container inside the inner space. At the same time air left in the inner space may be expelled, forced out by said deformation, such that the entire inner space 100 will be filled with the liquid and the gas container, for example preventing oxidation of the liquid without the necessity of further measures as known in the art, as for example inserting CO2 gas or water onto the liquid prior to closing the container 1.

By providing the gas container 6 in an upper portion of the container 1, the liquid will be forced to the lower portion of the container 1, when held with the neck 3 up, as shown in FIG. 5. This means that the centre of gravity Z of the container 1 will be lowered relative to for example the embodiment of FIG. 3, making it more stable.

Obviously the gas container 6 can also be blown up in a different manner, for example by directly forcing gas under pressure into the gas container.

In an alternative embodiment the pressure regulator device 5 can be filled with dry ice outside the beverage container 1, where after it is inserted at least partly into the beverage container and a dispensing device can be mounted to the beverage container. In another embodiment the pressure regulator and the dispensing device can be integrated, as shown for example in FIG. 3, and placed as a unit, after the dry ice 16 has been provided in the gas container 6. In yet another embodiment the gas container can be an integral part of the beverage container and can be filled with the desired amount of dry ice, prior to, during and/or after filling the beverage container 1 with the beverage. The container 6 for containing the dry ice can for example be made of metal or plastic, such as but not limited to PET or PEN or blends containing such plastic, or any other suitable material.

In an exemplary embodiment an amount of about 4 gram of dry ice is inserted into a container 6 having an internal volume of about 0.15 liter. Then the container 6 is closed and the dry ice is allowed to sublimate into gas. This will lead to about 2 liters of gas, compressed to a pressure within the container of about 12-14 bar (1200 to 1400 kPa) absolute. This was at least sufficient to expel about a liter of carbonated beverage, especially beer from a container, through a neck portion of the container when standing, through a dispense tube. It shall be clear to the person skilled in the art that for any amount of liquid to be dispensed an appropriate amount of dry ice can be provided in a container of a desired volume, depending on for example allowable starting pressure within the fully filled container, the dispense conditions, such as but not limited to counter pressure, temperature, dispensing volume, beverage container geometry, liquid type and/or available space for the container 6.

The invention is by no means limited to the embodiments described and/or disclosed herein. These embodiments are mere examples. Many variants are possible within the scope of the invention as defined by the appending claims, including combinations of embodiments disclosed or parts thereof. Furthermore, for example the beverage container can be made of metal or another suitable material or combination of materials. Moreover, the beverage container can be of a bag in container type, wherein the beverage is provided in a flexible bag within a more rigid outer container, the pressure regulator 5 opening into the space between the bag and the outer container. This will compress the bag and there through dispense the beverage, without contact between the gas, such as $CO_2$ gas, and the beverage. The pressure regulator can be made in different ways, and placed in different positions relative to the gas container and/or the beverage container. The pressure regulating device 5 can for example be mounted partly or entirely outside the beverage container 1, the pressure regulator opening into the beverage container for pressurising the beverage in the beverage container. These and other alternative embodiments are considered to have been disclosed herein as well.

The invention claimed is:

1. A method for manufacturing a pressurizing device for a beverage container, wherein a gas container is provided having a filling opening, into which gas container an amount of dry ice is inserted through the filling opening, where after the filling opening is closed and the dry ice is allowed to sublimate, wherein a pressure regulator is provided on the gas container for releasing gas from the gas container into a beverage compartment of the beverage container outside said gas container, wherein said pressure regulator is regulated based on a pressure prevailing in said beverage compartment, wherein the pressure regulator is designed for maintaining a substantially constant pressure inside the beverage container, wherein the gas container is mounted on or in the beverage container, wherein the gas container is suspended in a neck portion of the beverage container, such that part of the gas container extends into an inner space of the beverage container, past the neck portion, wherein the gas container is brought into fluid communication with the beverage compartment in the beverage container through the pressure regulator, wherein the filling opening of the gas container and a dispenser opening are closed by a common lid comprising dispensing means for a beverage and the pressure regulator.

2. The method of claim 1, wherein the amount of dry ice provided in the gas container is such that after sublimation the gas container is filled such that the internal pressure in the gas container is between 4 and 20 bar when measured at a temperature of about 6° C.

3. The method of claim 1, wherein an amount of gas absorbing and/or adsorbing material is provided in the gas container, wherein the gas absorbing and/or adsorbing material comprises $CO_2$ gas absorbing and/or adsorbing material.

4. The method of claim 3, wherein the amount of gas absorbing and/or adsorbing material provided in the gas container is active coal or zeolite.

5. The method of claim 1, wherein the dry ice is fed into the gas container as multiple solid elements.

6. The method of claim 5, wherein the multiple solid elements comprise power or granules.

7. The method of claim 1, wherein the gas container is mounted on or in a beverage container and dry ice is then placed into the gas container.

8. The method of claim 1, wherein the gas container is expanded and deformed plastically in the inner space by the gas formed by sublimation of the dry ice.

9. A method for manufacturing a pressurizing device for a beverage container, wherein a gas container is provided having a filling opening, into which gas container an amount of dry ice is inserted through the filling opening, where after the filling opening is closed and the dry ice is allowed to sublimate, wherein a pressure regulator is provided on the gas container for releasing gas from the gas container into a beverage compartment of the beverage container outside said gas container, wherein said pressure regulator is regulated based on a pressure prevailing in said beverage compartment, wherein the pressure regulator is designed for maintaining a substantially constant pressure inside the beverage container, wherein the gas container is suspended in a neck portion of the beverage container, at a dispense opening thereof, wherein the filling opening of the gas container and a dispense opening are closed by a common lid comprising dispensing means for the beverage and the pressure regulator.

10. A method for manufacturing a pressurizing device for a beverage container, wherein a gas container is provided having a filling opening, into which gas container an amount of dry ice is inserted through the filling opening, where after the filling opening is closed and the dry ice is allowed to sublimate, wherein a pressure regulator is provided on the gas container for releasing gas from the gas container into a beverage compartment of the beverage container outside said gas container, wherein said pressure regulator is regulated based on a pressure prevailing in said beverage compartment, wherein the pressure regulator is designed for maintaining a substantially constant pressure inside the beverage container, wherein the gas container is suspended in a neck portion of the beverage container, such that part of the gas container extends into an inner space of the beverage container, past the neck portion, wherein the gas container is brought into fluid communication with the beverage compartment through the pressure regulator, wherein the gas container and the beverage container are made of a plastic material, wherein the filling opening of the gas container and a dispense opening are closed by commom lid comprising dispensing means for a beverage and the pressure regulator.

11. The method according to claim 10, wherein the plastic material is PET.

* * * * *